US010465947B2

(12) United States Patent
Martin

(10) Patent No.: US 10,465,947 B2
(45) Date of Patent: Nov. 5, 2019

(54) STIRLING COOLER WITH FLUID TRANSFER BY DEFORMABLE CONDUIT

(71) Applicant: Thales, Courbevoie (FR)

(72) Inventor: Jean-Yves Martin, Blagnac (FR)

(73) Assignee: THALES, Courbevoie (FR)

( * ) Notice: Subject to any disclaimer, the term of this patent is extended or adjusted under 35 U.S.C. 154(b) by 157 days.

(21) Appl. No.: 15/556,617

(22) PCT Filed: Mar. 14, 2016

(86) PCT No.: PCT/EP2016/055432
§ 371 (c)(1),
(2) Date: Sep. 8, 2017

(87) PCT Pub. No.: WO2016/146572
PCT Pub. Date: Sep. 22, 2016

(65) Prior Publication Data

US 2018/0058731 A1 Mar. 1, 2018

(30) Foreign Application Priority Data

Mar. 13, 2015 (FR) ..... 15 00486

(51) Int. Cl.
*F25B 9/14* (2006.01)

(52) U.S. Cl.
CPC ..... *F25B 9/14* (2013.01); *F25B 2309/003* (2013.01)

(58) Field of Classification Search
CPC ..... F25B 9/14; F25B 2309/003; F25B 9/145; F25B 2309/00; F25B 2309/001;
(Continued)

(56) References Cited

U.S. PATENT DOCUMENTS 4,365,982 A * 12/1982 Durenec ..... F25B 9/14 62/6
4,442,670 A * 4/1984 Goldman ..... F02G 1/04 60/508

(Continued)

FOREIGN PATENT DOCUMENTS

CN 2700781 Y 5/2005
CN 201992902 U 9/2011

(Continued)

OTHER PUBLICATIONS

French Patent Application No. 15 00486, Rapport de Recherche Préliminaire, Jan. 14, 2016, 2 pages.

(Continued)

*Primary Examiner* — Justin M Jonaitis
(74) *Attorney, Agent, or Firm* — Soquel Group LLC

(57) ABSTRACT

A cooler operating according to the Stirling cycle, including a housing including a compression cylinder and a regeneration cylinder, a movable compression piston and a movable regeneration piston, that can move in translational motion in the compression cylinder and in the regeneration cylinder, a driving crankshaft, including a rotating crank pin, and two connecting rods coupled to the compression piston and the regeneration piston, the connecting rods being coupled to the rotating crank pin, a fluid flow duct for circulating fluid, connecting the compression cylinder and the regeneration cylinder, one end of the fluid flow duct being disposed on the regeneration piston, and the fluid flow duct including a deformable pipe that is deformed in accordance with the movement of the compression piston and/or of the regeneration piston.

6 Claims, 3 Drawing Sheets

(58) Field of Classification Search
CPC ..... F25B 2309/002; F25B 2309/004; F25B 2309/006; F25B 2309/14; F25B 2309/1401; F25B 2309/1402; F25B 2309/1403; F25B 2309/1404; F25B 2309/1405; F25B 2309/1406; F25B 2309/1407; F25B 2309/1408; F25B 2309/1409; F25B 2309/1411; F25B 2309/1412; F25B 2309/1413; F25B 2309/1414; F25B 2309/1415; F25B 2309/1416; F25B 2309/1417; F25B 2309/1418; F25B 2309/14181; F25B 2309/1419; F25B 2309/1421; F25B 2309/1422; F25B 2309/1423; F25B 2309/1424; F25B 2309/14241; F25B 2309/1425; F25B 2309/1426; F25B 2309/1427; F25B 2309/1428; F25J 1/0225; F25J 1/0227; F25J 2270/90; F25J 2270/912; F02G 1/0435; F02G 2243/20; F02G 2243/24; F02G 1/04; F02G 1/043; F02G 2243/00; F02G 2243/02; F02G 2250/18; F02G 2250/17; F02G 1/044; F02G 2243/30
USPC ..... 62/6, 51.2; 60/520, 517, 525
See application file for complete search history.

(56) References Cited

U.S. PATENT DOCUMENTS

| | | | | |
|---|---|---|---|---|
| 5,056,317 | A * | 10/1991 | Stetson | F25B 9/14 60/520 |
| 5,505,047 | A * | 4/1996 | Hirose | F02G 1/043 60/520 |
| 5,611,201 | A * | 3/1997 | Houtman | F02G 1/043 60/517 |
| 5,632,149 | A * | 5/1997 | Tanigawa | F02G 1/055 60/520 |
| 6,397,605 | B1 | 6/2002 | Pundak | |

FOREIGN PATENT DOCUMENTS

| | | | | |
|---|---|---|---|---|
| CN | 102654325 | A | 9/2012 | |
| DE | 41 42 368 | A1 | 7/1992 | |
| EP | 0311726 | A2 | 4/1989 | |
| EP | 0 778 452 | A1 | 6/1997 | |
| EP | 0778452 | A1 * | 6/1997 | F02B 75/34 |
| JP | 2734634 | B2 | 9/1998 | |

OTHER PUBLICATIONS

PCT Application No. PCT/EP2016/055432, International Search Report, dated Jun. 23, 2016, 4 pages.

* cited by examiner

STIRLING COOLER WITH FLUID TRANSFER BY DEFORMABLE CONDUIT

The present invention relates to a cooler operating according to the Stirling cycle, of the type comprising: a housing that defines an internal volume filled with a fluid, the said housing including a compression cylinder and a regeneration cylinder; a movable compression piston that can move in translational motion in the compression cylinder; a movable regeneration piston that can move in translational motion in the regeneration cylinder; the housing and the compression piston and the regeneration piston respectively defining a compression chamber, a regeneration chamber, and a reference chamber disposed between the compression piston and the regeneration piston; a driving crankshaft, comprising a rotating crank pin that can rotate relative to the housing; and a compression connecting rod coupled to the compression piston and a regeneration connecting rod coupled to the regeneration piston, the said connecting rods being rigid, with the said connecting rods in addition being coupled to the rotating crank pin; the rotating crank pin and the compression and regeneration connecting rods being disposed in the reference chamber; with the cooler further comprising a fluid flow duct for circulating fluid, a first end of the said duct opening out on to the compression chamber and a second end of the said duct opening out on to the regeneration chamber.

Such a cooler is in particular described in the document U.S. Pat. No. 3,851,173.

In a known manner, the ideal Stirling cycle comprises the following four phases:

- an isothermal compression of a fluid at a hot temperature, obtained by the displacement of a compression piston in a compression cylinder;
- the isochoric cooling of the fluid, from a hot temperature to a cool temperature, obtained by the passing of the fluid through a regeneration piston, the said piston being in motion within a regeneration cylinder and serving the purpose of a heat exchanger;
- an isothermal expansion of the fluid at the cool temperature, obtained by the return of the compression piston in the compression cylinder; and
- an isochoric heating of the fluid, from the cool temperature to the hot temperature, obtained by return of the regeneration piston in the regeneration cylinder.

In a known manner, in a cooler of the aforementioned type, the passage of the fluid between the compression cylinder and the regeneration cylinder is ensured by a rigid duct, running through the housing and the regeneration piston. A clearance between the regeneration cylinder and the piston sliding within the said cylinder must be sufficiently small in order for the fluid to be forced through the heat exchanger with a minimum of losses.

However, the appropriate technologies that are adapted for this type of small clearance, for example of the "clearance seal" type, entail various constraints and high costs of production and limited useful life with respect to the parts.

The objective of the present invention is to provide a device that ensures the passage of fluid between the compression cylinder and the regeneration cylinder, while reducing the constraints and costs associated therewith.

To this end, the object of the invention relates to a cooler of the aforementioned type, in which the second end of the fluid flow duct is disposed on the regeneration piston; and the said fluid flow duct comprises a flexible deformable pipe that is deformed in accordance with the movement of the compression piston and/or of the regeneration piston, the said deformable pipe being disposed in the reference chamber.

According to other advantageous aspects of the invention, the cooler includes one or more of the following characteristic features, taken into consideration individually or in accordance with all possible technical combinations:

- the first end of the fluid flow duct corresponds to one end of a bore formed in the housing between the compression chamber and the reference chamber, with the deformable pipe extending the said bore;
- the first end of the fluid flow duct corresponds to one end of the deformable pipe and is disposed on the compression piston;
- the first connecting rod is connected to the compression piston by an articulated joint;
- the first connecting rod is mounted in a fixed manner on the compression piston; the compression piston comprises a curved edge in a manner so as to be able to oscillate when in contact with the compression cylinder, in a plane that includes an axis of movement of the said piston; and the first end of the fluid flow duct corresponds to one end of a bore formed in the compression piston and the first connecting rod, between the compression chamber and the reference chamber, with the deformable pipe extending the said bore;
- the deformable pipe is a flexible pipe;
- the deformable pipe is formed of rigid sections separated by at least two flexible zones.

The invention will be better understood upon reading the description which follows, provided purely by way of non-limiting example and with reference being made to the drawings in which.

Figure 1:
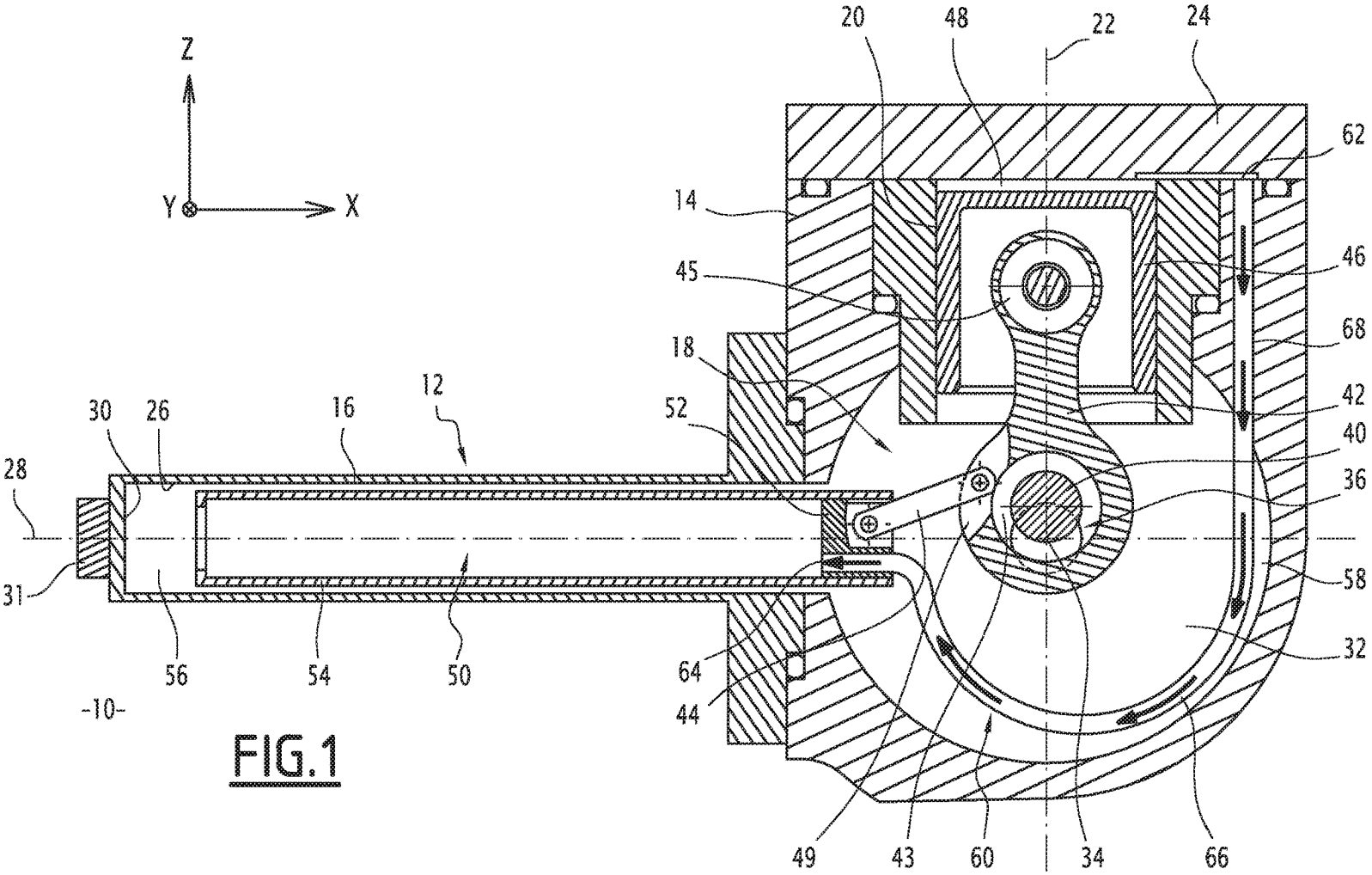
FIG. 1 is a cross-sectional view of a cooler according to a first embodiment of the invention.

FIG. 1 represents a cross-sectional view of a device 10 according to a first embodiment of the invention. The device 10 is a cooler operating according to the Stirling cycle. The device 10 includes a housing 12. The said housing 12 comprises in particular a body 14 and a cryostat well 16, assembled to one another and together defining an internal volume 18 within the housing. The internal volume 18 is preferably filled with a high purity gas such as helium.

In the following sections of the description, an orthonormal base (X, Y, Z) is considered.

The body 14 of the housing in particular defines a first internal wall 20, having a cylindrical form, disposed along a first axis 22 that is parallel to Z. The said internal wall 20 is referred to as the compression cylinder. The housing 12 further also includes a flange 24 assembled on to the body 14. The flange 24 closes an orifice situated at a first axial end of the compression cylinder 20.

The cryostat well 16 defines a second internal wall 26, having a cylindrical form, disposed along a second axis 28 that is inclined in relation to the first axis 22. In the example represented in FIG. 1, the second axis 28 is parallel to X, that is to say, perpendicular to the first axis 22. The second axis 28 is substantially coplanar to the first axis 22.

The second internal wall 26 is referred to as the regeneration cylinder. A first axial end 30 of the regeneration cylinder 26, referred to as the cold end, is closed. In a conventional manner, the cold end 30 is in contact with an element 31 to be cooled by means of the device 10, for example an electronic component.

The second axial ends of the compression cylinder 20 and of the regeneration cylinder 26 communicate with a central space 32 of the housing 12. The central space 32 is substantially cylindrical, disposed along a third axis 34 that is parallel to Y. Preferably, the third axis 34 passes through an intersection of the first and second axes 22, 28, or in the proximity of the said intersection.

The central space 32 accommodates a crankshaft system 36, connected to a motor (not shown). The crankshaft 36 includes a motor shaft disposed along the third axis 34. Mounted in a fixed manner on the motor shaft is an eccentric crank pin 40. The crank pin 40 is coupled to a first connecting rod 42 and to a second connecting rod 44, the said first and second connecting rods 42, 44 being disposed substantially within the plane (X, Z) containing the first and second axes 22, 28. According to one variant, the first and second connecting rods 42, 44 are disposed in a plane that is parallel to the plane containing the first and second axes 22, 28.

The first connecting rod 42 is a rigid piece, that is mounted on to the crank pin 40 by means of a bearing 43. An articulated joint 45 connects the said first connecting rod 42 to a first piston 46, referred to as the compression piston. The compression piston 46 is movable in translational motion along the first axis 22 in the compression cylinder 20, which guides the piston 46 during its movement. Preferably, a leak between the compression cylinder 20 and the central space 32 is as low as possible in order to ensure and maintain a good performance level in the device 10.

In the present description, the term "compression piston" may also be applicable to a compression membrane.

The compression piston 46 defines a compression chamber 48 in the compression cylinder 20 between the flange 24 and the said compression piston 46. The compression chamber 48 has a variable volume that varies based on the movement of the piston 46.

The second connecting rod 44 is a rigid piece, of which a first end is joined in an articulated manner on a finger-piece 49 of the first connecting rod 42 and a second end is joined in an articulated manner on to a second piston 50, referred to as the regeneration piston. The regeneration piston 50 is movable in translational motion along the second axis 28 in the regeneration cylinder 26.

The regeneration piston 50 comprises a base 52, that is joined in an articulated manner on to the second connecting rod 44. The piston 50 further also comprises a tube 54 which extends from the base 52 in the regeneration of cylinder 26, in the direction towards the cold end 30. Typically, the interior of the tube 54 is packed with a porous material (not shown) that is capable of heat exchange with the fluid that passes therethrough by virtue of the movement of the compression piston 48. The porous material is for example formed by a stack of metal meshes.

The clearance between the regeneration piston 50 and the regeneration cylinder 26 may be greater than the clearance between the compression piston 46 and the compression cylinder 20.

The regeneration piston 50 defines a regeneration chamber, or an expansion chamber 56, located in the regeneration cylinder 26 between the cold end 30 and the said regeneration piston 50. The regeneration chamber 56 has a variable volume that varies based on the movement of the piston 50.

The compression piston 46 and the regeneration piston 50 also define a pressure reference chamber 58, within which is disposed the crank shaft system 36 and the connecting rods 42, 44. The central space 32 is in particular included in the reference chamber 58. The said chamber 58 has a variable volume that varies based on the movement of the pistons 46, 50.

The device 10 further comprises a fluid flow duct 60 for circulating fluid, which provides for a pneumatic connection between the compression chamber 48 and the regeneration chamber 56. More precisely, a first end 62 of the duct 60 opens out on to the compression chamber 48 and a second end 64 of the duct 60 opens out on to the base 52 of the regeneration piston 50.

The second end 64 is formed by an inlet that is axial, or parallel to X, through the base 52 of the piston 50. The second end 64 is connected to a pipe 66 disposed in the reference chamber 58.

From the second end 64, the pipe 66 bypasses the axis 34 of rotation of the crankshaft 36 and is connected to a bore 68, formed in the housing 12 substantially parallel to the compression cylinder 20. The bore 68 opens out into the compression chamber 48 at the level of the first end 62 of the duct 60.

The pipe 66 is deformable in accordance with the movement of the regeneration piston 50. In the exemplary embodiment represented in FIG. 1, the pipe 66 is a flexible pipe, such as a pipe made of plastic material that may or may not be reinforced. According to one variant embodiment (not shown), the pipe 66 is formed of rigid sections that are separated by at least two flexible zones.

Figure 2:
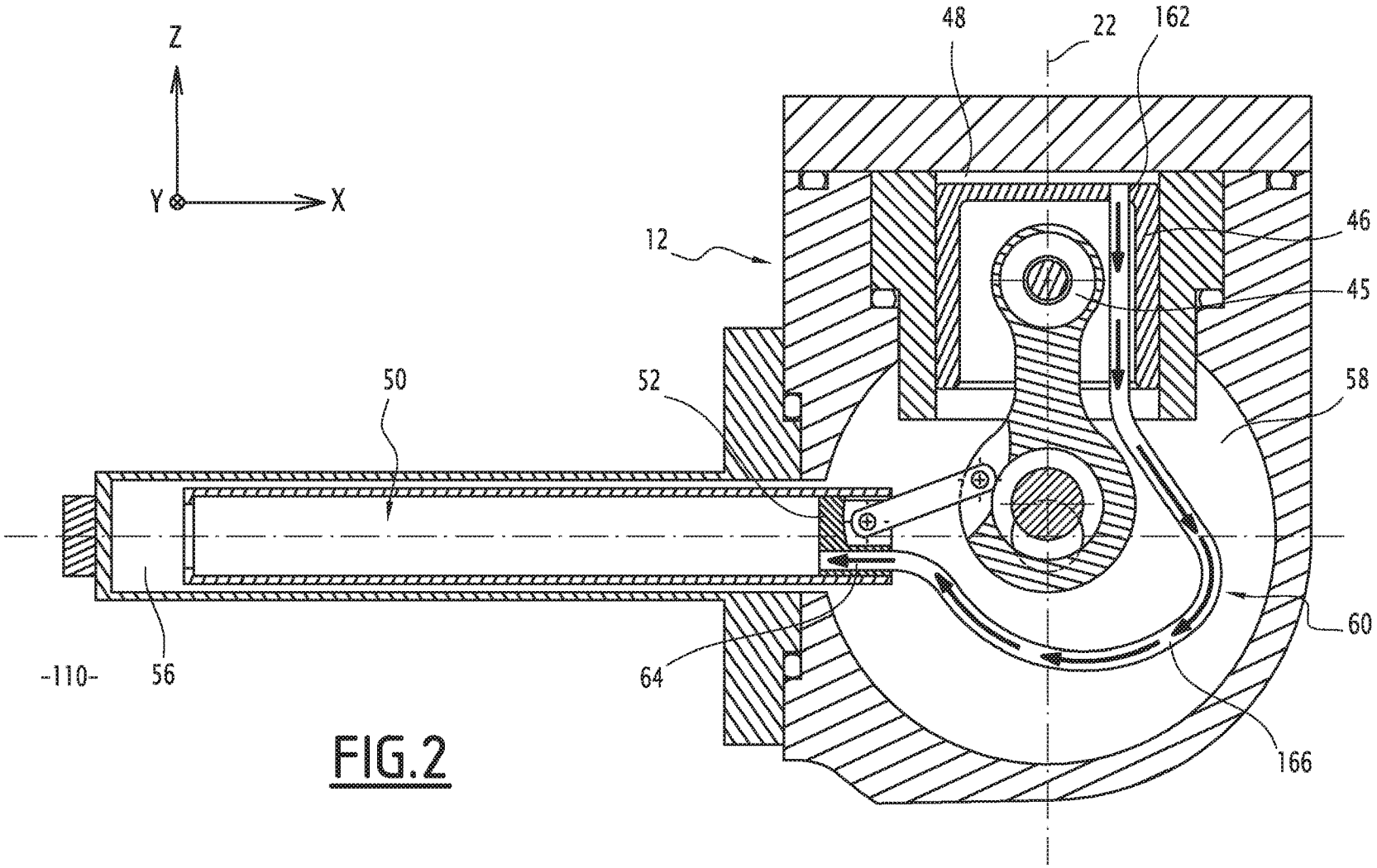
FIG. 2 is a cross-sectional view of a cooler according to a second embodiment of the invention.

FIG. 2 represents a cross-sectional view of a device 110 according to a second embodiment of the invention. The device 110 is a cooler operating according to the Stirling cycle, that is analogous to the device 10 shown in FIG. 1. In the following sections of the description, the elements that are common to the devices 10 and 110 are denoted by the same reference numerals.

The description provided here above of the device 10 is applicable to the device 110, with the exception of the characteristic features of the fluid flow duct 60 for circulating fluid between the compression chamber 48 and the regeneration chamber 56.

More precisely, the duct 60 of the device 110 has a second end 64 which opens out on to the regeneration chamber 56 by means of an axial inlet in the base 52 of the regeneration piston 50, in a similar manner to the device 10.

The duct 60 of the device 110 on the other hand has a first end 162 that opens out on to the compression chamber 48. In contrast to the first end 62 of the device 10, the first end 162 is not formed in the housing 12. The first end 162 is formed by an inlet that is axial, or parallel to Z, in the compression piston 46.

The first 162 and second 64 ends of the duct 60 of the device 110 correspond to the ends of a pipe 166, disposed in the reference chamber 58 and connected to the regeneration piston 50 and to the compression piston 46.

As in the case of the pipe 66 of the device 10, the pipe 166 is deformable in accordance with the movement of the regeneration piston 50 and of the compression piston 46. In the exemplary embodiment represented in FIG. 2, the pipe 166 is a flexible pipe; according to one variant embodiment (not shown), the pipe 166 is formed of rigid sections that are separated by at least two flexible zones.

Figure 3:
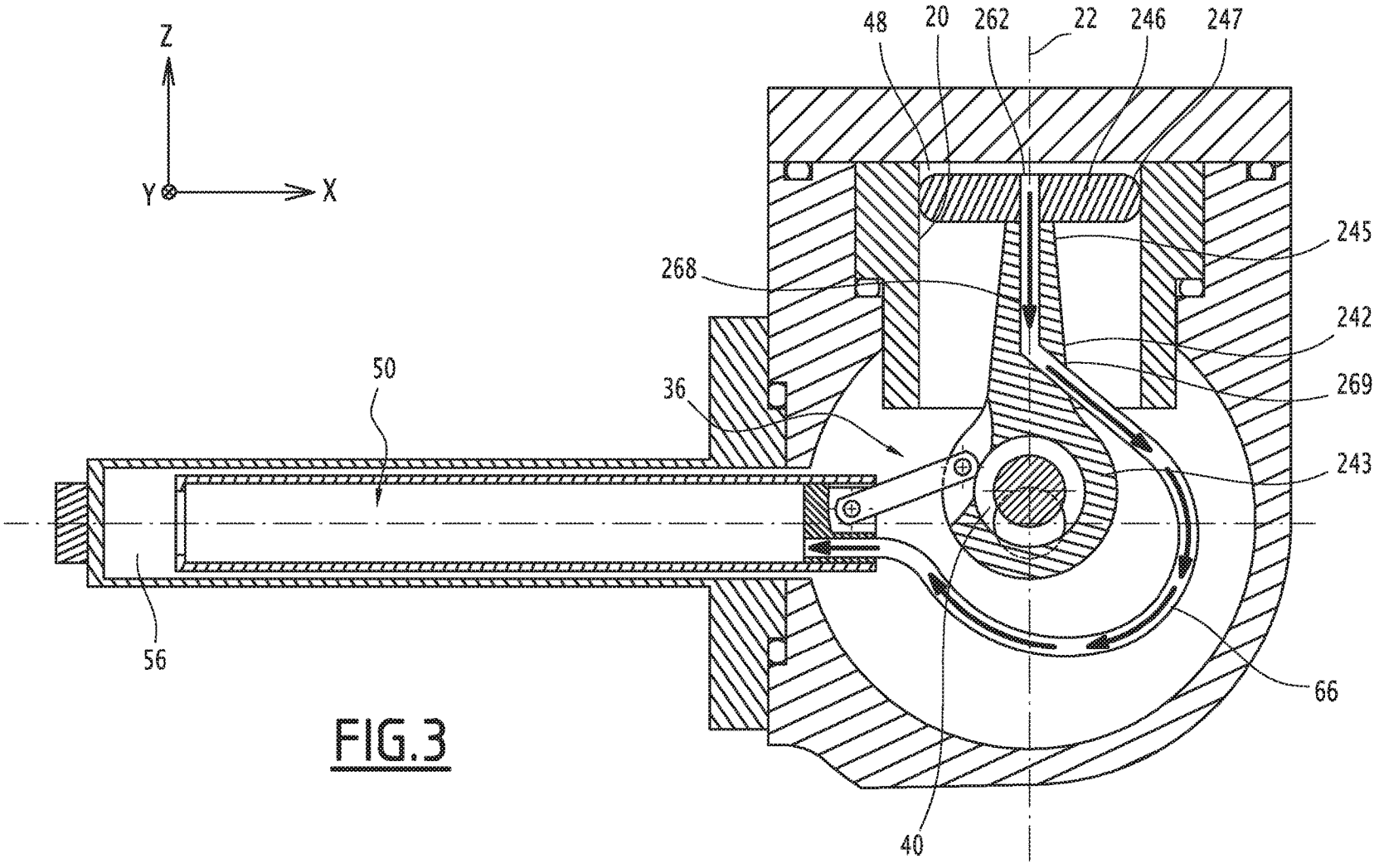
FIG. 3 is a cross-sectional view of a cooler according to a third embodiment of the invention.

FIG. 3 represents a cross-sectional view of a device 210 according to a third embodiment of the invention. The device 210 is a cooler operating according to the Stirling cycle, that is analogous to the devices 10 and 110 shown in FIGS. 1 and 2. In the following sections of the description, the elements that are common to the devices 10, 110 and 210 are denoted by the same reference numerals.

The description provided here above of the device 10 is applicable to the device 210, with the exception of the following characteristic features:

The device 210 comprises a movable compression piston 246 that can move in translational motion in the compression cylinder 20. A radial edge 247 of the piston 246, when in contact with the said cylinder 20, presents a convex section in a plane that passes through the first axis 22 of movement of the piston 246. In an optional manner, a seal between the compression cylinder 20 and the radial edge 247 of the piston 246 is obtained by means of a flexible radial seal (not shown) carried by the piston. The piston 246 is for example analogous to the piston described in the document U.S. Pat. No. 5,231,917.

Furthermore, the crankshaft system 36 of the device 210 comprises a first rigid connecting rod 242. A head 243 of the first connecting rod 242 is coupled to the eccentric crank pin 40 of the crankshaft 36. A finger-piece 245 of the first connecting rod 242 is mounted in a fixed manner on to the compression piston 246. On the contrary, in the case of the devices 10, 110, the first connecting rod 42 is joined in an articulated manner on the compression piston 46.

The device 210 comprises a fluid flow duct 60 for circulating fluid between the compression chamber 48 and the regeneration chamber 56.

The duct 60 of the device 210 has a second end 64 which opens out on to the regeneration chamber 56 by means of an axial inlet in the base 52 of the regeneration piston 50, in a similar manner to the devices 10 and 110. The second end 64 is connected to a pipe 66 disposed in the reference chamber 58.

From the second end 64, the pipe 66 bypasses the axis of rotation of the crankshaft 36 and is connected to a bore 268, formed in particular in the interior of the rigid connecting rod 242 and of the compression piston 246. A first end 269 of the bore 268 opens out into the reference chamber 58, in the proximity of the head of the connecting rod 243. A second end 262 of the bore 268 forms an axial inlet in the piston 246 and opens out into the compression chamber 48. Preferably, the second end 262 is located close to the first axis 22 of the compression cylinder 20.

The pipe 66 is deformable in accordance with the movement of the regeneration piston 50 and of the compression piston 46. In the exemplary embodiment shown in FIG. 3, the pipe 166 is a flexible pipe; according to one variant embodiment (not shown), the pipe 166 is formed of rigid sections that are separated by at least two flexible zones.

An operating method for operation of the devices 10, 110 and 210 will now be described, according to the steps of a Stirling cycle that are known as such.

The eccentric crank pin 40 is driven in rotation by the motor shaft of the crankshaft 36 about the axis 34. By means respectively, of the first connecting rod 42, 242 and of the second connecting rod 44, the rotation of the crank pin 40 is converted into reciprocating rectilinear movement of the compression piston 46, along the first axis 22, and of the regeneration piston 50, along the second axis 28. The movements of the pistons 46, 50 are of substantially sinusoidal type. The movements of the pistons 46, 50 are out of phase with each other by approximately 90°, that is to say that one of the two pistons 46, 50 is at the mid-point of the stroke when the other of the said two pistons is at one end of its stroke.

For example, it is considered that the compression piston 46, 246 moves along the first axis 22, in the direction towards the flange 24. In the configuration represented in FIG. 1 to FIG. 3, the compression chamber 48 has almost reached its minimum volume. The helium contained in the said chamber reaches a maximal pressure range and is driven into the regeneration piston 50 through the duct 60. The said regeneration piston is thus then substantially at the mid-point of the stroke in the regeneration cylinder 26 and moves in the direction away from the cold end 30.

The helium passes through the tube 54 of the piston 50 and is cooled upon contact with the heat exchanger contained in the said tube. The regeneration piston 50 continues its stroke in the regeneration cylinder 26 up to a point of maximal expansion of the regeneration chamber 56. Furthermore, the compression piston 46, 246 moves within the compression cylinder 20 in a manner so as to increase the volume of the compression chamber 48, while reducing the pressure of the helium. The return of the regeneration piston 50, combined with the continuing of the expansion of volume of the compression chamber 48, leads the helium to pass through the tube 54 in the opposite direction. The helium then recovers the heat and rises in temperature, before returning into the compression chamber 48 by way of the duct 64, 66. The compression piston 50 continues its stroke up to a point of maximal expansion of the compression chamber 48, and subsequently heads back in the reverse direction in order to again compress the fluid and complete the cycle.

In the particular case of the device 210, the rotary motion of the crank pin 40 is transmitted to the first connecting rod 242, which is itself fixed on to the compression piston 246. The convex edge 247 of the said piston makes it possible for the said piston 246 to slightly oscillate in a plane (X, Z), while remaining in contact with the internal wall of the cylinder 20, during the stroke of the said piston along the first axis 22. The convex edge 247 makes it possible to eliminate the articulated joint 45 between the piston 46 and the connecting rod 42, as is described for the devices 10 and 110.

In addition, the deformable pipe 66, 166 of the duct 60 serves to enable a transfer of the gas stream without any loss. This characteristic feature makes possible, between the piston 50 and the regeneration cylinder 26, a clearance that is greater than that of the devices as described in the document U.S. Pat. No. 3,851,173. In addition, this characteristic feature makes it possible to eliminate complex and bulky mechanical parts, and in particular to reduce the length of the cryostat well.

The coolers according to the invention such as the devices 10, 110, 210 therefore involve facilitated manufacturing and maintenance operations.

According to one variant of the embodiments described here above, the second end 64 of the duct 60 is formed by an inlet that is radial, and not axial, on the regeneration piston 50.

The invention claimed is:

1. A cooler operating according to the Stirling cycle, comprising:

a housing that defines an internal volume filled with a fluid, the housing including a compression cylinder and a regeneration cylinder;

a movable compression piston that can move in translational motion in said compression cylinder;

a movable regeneration piston that can move in translational motion in said regeneration cylinder, said housing and said compression piston and the regeneration piston respectively defining a compression chamber, a regeneration chamber, and a reference chamber disposed between said compression piston and the regeneration piston;

a driving crankshaft, comprising a rotating crank pin, that can rotate relative to said housing;

a compression connecting rod coupled to said compression piston and a regeneration connecting rod coupled to said regeneration piston, the connecting rods being rigid, with the connecting rods in addition being coupled to said rotating crank pin, said rotating crank pin and the compression and regeneration connecting rods being disposed in the reference chamber; and a fluid flow duct for circulating fluid, a first end of the duct opening out on to the compression chamber and a second end of the duct opening out on to the regeneration chamber, wherein the first end of the fluid flow duct corresponds to one end of a bore formed in said housing between the compression chamber and the reference chamber, with a deformable pipe extending the bare, and wherein the second end of the fluid flow duct is disposed on said regeneration piston, and wherein the fluid flow duct comprises the flexible deformable pipe that is deformed in accordance with the movement of said compression piston and/or of said regeneration piston, the deformable pipe being disposed in the reference chamber.

2. A cooler according to claim 1, in which said compression connecting rod is connected to said compression piston by an articulated joint.

3. A cooler according to claim 1, in which said deformable pipe is a flexible pipe.

4. A cooler according to claim 1, in which said deformable pipe is formed of rigid sections separated by at least two flexible zones.

5. A cooler according to claim 2, wherein the deformable pipe is a flexible pipe.

6. A cooler according to claim 2, wherein the deformable pipe is formed of rigid sections separated by at least two flexible zones.

* * * * *